US009186927B1

(12) United States Patent
Bogdanski et al.

(10) Patent No.: US 9,186,927 B1
(45) **Date of Patent: *Nov. 17, 2015**

(54) GREETING CARD WITH SPRING LOADED SLIDE TRACK ACTIVATED AUDIO

(71) Applicant: American Greetings Corporation, Cleveland, OH (US)

(72) Inventors: Sharon Bogdanski, Westlake, OH (US); John Talbot, Bay Village, OH (US); Lauren Budzar, Seven Hills, OH (US); Mary McClain, Shaker Heights, OH (US); Brent Cottrell, Amherst, OH (US); Melissa Cornet, Shaker Heights, OH (US); Dave McPeek, Strongsville, OH (US); Brian Cleary, Cleveland, OH (US); Melissa Flesher, Avon, OH (US); Beth Dinvald, Cleveland, OH (US); Tiger Qiao, Shanghai (CN); Jerry Guo, Shanghai (CN)

(73) Assignee: American Greetings Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/270,044

(22) Filed: May 5, 2014

Related U.S. Application Data

(60) Continuation of application No. 13/735,649, filed on Jan. 7, 2013, now Pat. No. 8,726,547, which is a continuation-in-part of application No. 13/270,611, filed on Oct. 11, 2011, now Pat. No. 8,448,361, which (Continued)

(51) Int. Cl.

| | |
|---|---|
| ***G09F 1/00*** | (2006.01) |
| ***B42D 15/02*** | (2006.01) |
| ***G09F 19/02*** | (2006.01) |

(52) U.S. Cl.
CPC ..... *B42D 15/022* (2013.01); *G09F 19/02* (2013.01); *G09F 1/00* (2013.01)

(58) Field of Classification Search
CPC .. B42D 15/022; B42D 15/042; B42D 15/045; G09F 1/06; G09F 27/00; G09F 1/00; A47G 1/0622; A63F 3/00643; A63F 3/065
USPC ..... 40/124.02, 124.03, 411, 415, 421, 445; 472/54, 55, 51; 446/147, 149, 150, 446/310, 311
See application file for complete search history.

(56) References Cited

U.S. PATENT DOCUMENTS 1,988,045 A * 1/1935 Morris ..... 40/445
2,884,724 A * 5/1959 Lohnes et al. ..... 446/151

(Continued)

*Primary Examiner* — Casandra Davis
(74) *Attorney, Agent, or Firm* — Christine Flanagan

(57) ABSTRACT

An interactive greeting card having a multi-panel greeting card body, a sound module and a molded track contained between two or more panels of the multi-panel greeting card body, and a moveable object which is attached to the molded track through an opening in one or more of the greeting card panels. The moveable object is operative to move from one end of the molded track to the opposite end of the molded track whereby playback of a pre-recorded digital audio file is initiated. The interactive greeting card may additionally contain a small motor which causes movement of a second moveable object and an object launcher which is operative to launch an object along the track and into the air. Other special effects may be included such as lights, additional sounds or movement, or any other special effects which can be incorporated into a greeting card.

5 Claims, 11 Drawing Sheets

Related U.S. Application Data is a division of application No. 12/940,145, filed on Nov. 5, 2010, now Pat. No. 8,230,624, said application No. 13/735,649 is a continuation-in-part of application No. 13/470,499, filed on May 14, 2012, now Pat. No. 9,056,517.

(60) Provisional application No. 61/583,701, filed on Jan. 6, 2012, provisional application No. 61/485,298, filed on May 12, 2011.

(56) References Cited

U.S. PATENT DOCUMENTS

| | | | | |
|---|---|---|---|---|
| 3,246,897 | A * | 4/1966 | Waldrop | 273/348.3 |
| 3,572,712 | A * | 3/1971 | Vick | 463/60 |
| 5,439,230 | A * | 8/1995 | Mendes, Jr. | 273/349 |
| 8,726,547 | B2 * | 5/2014 | Bogdanski et al. | 40/124.03 |
| 2008/0254846 | A1 * | 10/2008 | Magers et al. | 463/7 |

* cited by examiner

GREETING CARD WITH SPRING LOADED SLIDE TRACK ACTIVATED AUDIO

RELATED APPLICATIONS

This application is a continuation of U.S. patent application Ser. No. 13/735,649, filed on Jan. 7, 2013, which claims priority to U.S. Provisional Patent Application No. 61/583,701, filed on Jan. 6, 2012, and which is a continuation-in-part of U.S. patent application Ser. No. 13/270,611, filed on Oct. 11, 2011 (now U.S. Pat. No. 8,448,361), which is a divisional of U.S. patent application Ser. No. 12/940,145, filed on Nov. 5, 2010 (now U.S. Pat. No. 8,230,624). U.S. patent application Ser. No. 13/735,649, filed on Jan. 7, 2013 is also a continuation-in-part of U.S. patent application Ser. No. 13/470,499, filed on May 12, 2012, which claims priority to U.S. Provisional Patent Application No. 61/485,298, filed on May 12, 2011.

Each of the above-referenced patent applications is incorporated herein in its entirety.

FIELD OF THE INVENTION

The present invention is in the field of greeting cards and more specifically to greeting cards having a spring loaded, slide track audio trigger mechanism.

BACKGROUND OF THE INVENTION

For many years paper greeting cards containing text sentiment and associated artwork have been widely used for celebratory occasions such as birthdays, graduations, weddings, and for other commercial purposes. More recently, greeting cards have been enhanced by incorporating sound and other effects. Sound generating devices have been incorporated into traditional paper greeting cards to increase entertainment value and emotional impact. In some forms, a talking or musical greeting card looks just like a conventional greeting card, except that it includes a hidden sound module with a pre-recorded sound track. Opening the greeting card will automatically turn on or close a switch so that the sound module will play the pre-stored music or dialog and closing the greeting card will automatically open the switch and stop the play of the music or dialog.

There is a need in the art for a greeting card that increases the entertainment value and raises the surprise factor of traditional or sound generating greeting cards that may still be mailed to a recipient and is relatively similar in size and thickness to a traditional paper greeting.

SUMMARY OF THE INVENTION

An interactive greeting card is described herein having a multi-panel greeting card body, a sound module and a molded track contained between two or more panels of the multi-panel greeting card body, and a moveable object which is attached to the molded track through an opening in one or more of the greeting card panels. The moveable object is operative to move from one end of the molded track to the opposite end of the molded track whereby playback of a pre-recorded digital audio file is initiated. The interactive greeting card may additionally contain a small motor which causes movement of a second moveable object and an object launcher which is operative to launch an object along the track and into the air. Other special effects may be included such as lights, additional sounds or movement, or any other special effects which can be incorporated into a greeting card. Various switches may be used to control the various effects.

DETAILED DESCRIPTION OF PREFERRED AND ALTERNATE EMBODIMENTS

The greeting card of the present invention provides an interactive experience for a greeting card recipient wherein the recipient opens a greeting card, revealing an object attached to a molded track. The recipient moves the object along the molded track so that once the object reaches the end of the track, a special effect, such as audio, lights, movement, or other such effect is initiated. A combination of special effects may also be used. In an alternate embodiment, a second mobile object is located within the greeting, the second mobile object being attached to a small motor which is concealed between the greeting card panels. Once the first mobile object reaches the end of the guided track or path, a second mobile object begins to move independently, in perhaps an up and down, back and forth, or other reciprocating motion. In still another embodiment, the molded track is used in combination with a spring loaded trigger which operates as an object launcher, wherein an object is inserted onto a launch mechanism, moved along the molded track and released upon the user pressing a launch or release button or other trigger mechanism.

In each of the embodiments of the present invention, the greeting card includes a multi-panel traditional paper greeting card. In a preferred embodiment, the greeting card contains three greeting card panels attached along two fold lines, however, any number of greeting card panels may be used in any configuration. The greeting card panels conceal electronic components, which may include but are not limited to: a circuit board, an integrated circuit, a memory device, a speaker, a power source, a motor module, and any other electronic component which is required or which facilitates saving, storing and emit sound or facilitates other special effects such as lights or movement of a mobile component, or other such effect. The panels also conceal a substantial portion of a molded track which guides a mobile component or object along the track path to trigger audio or other special effects.

Figure 1:
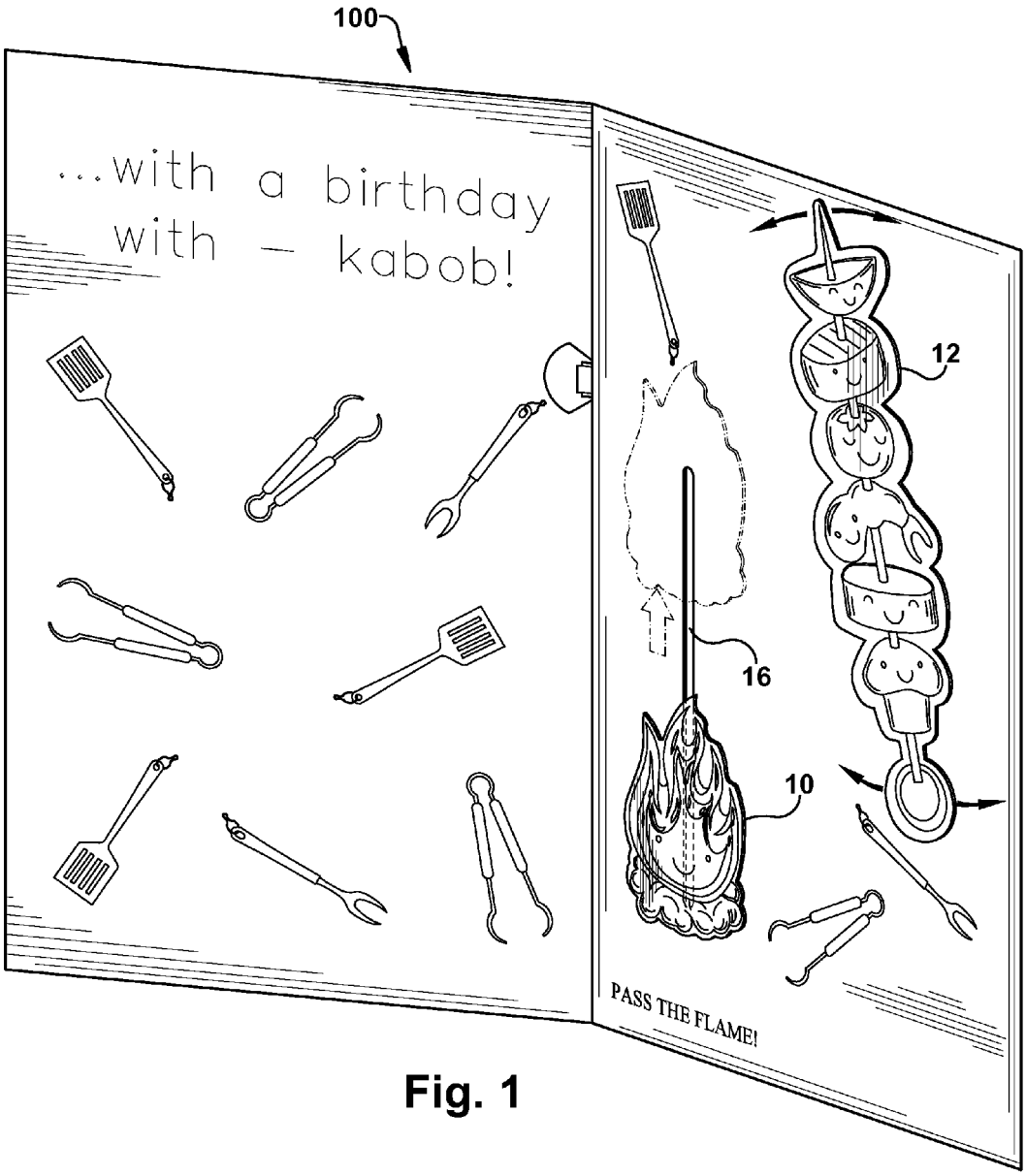
FIG. 1 is a perspective view of a first embodiment of the greeting card of the present invention.
Figure 2:
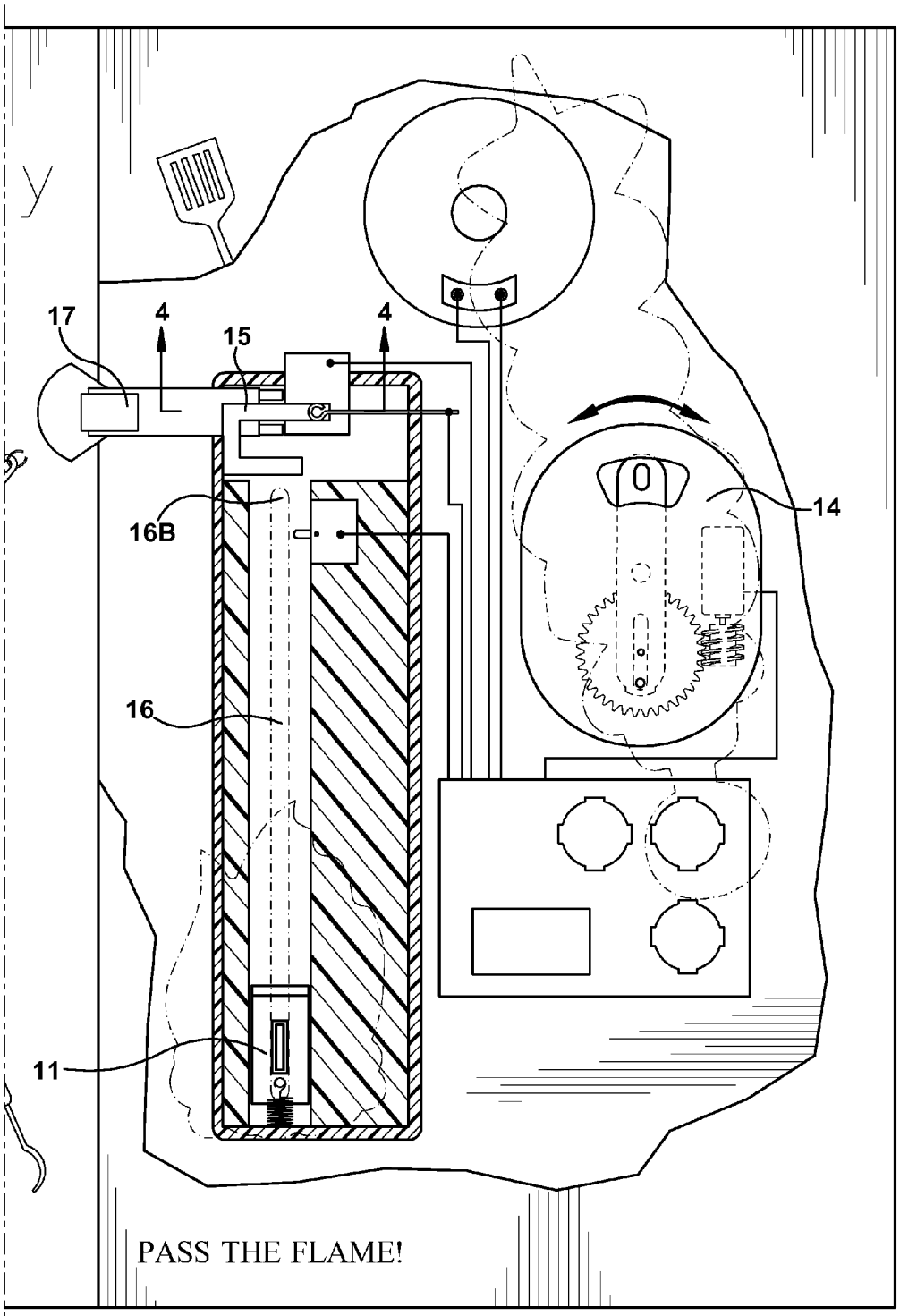
FIG. 2 is a top down view of the track/spring mechanism of the greeting card of FIG. 1, with the moveable object and retaining mechanism in a first position.
Figure 3:
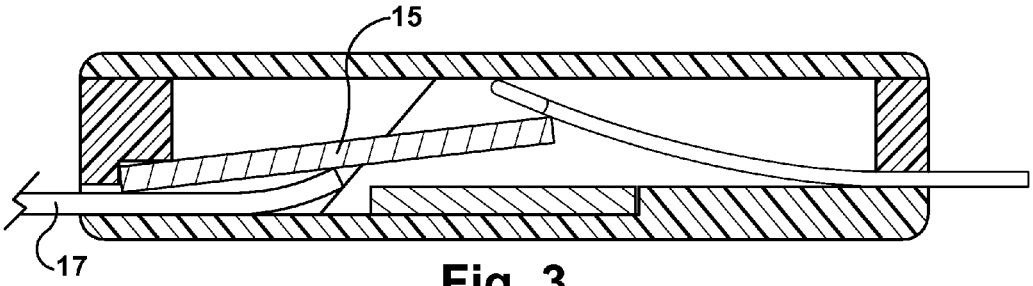
FIG. 3 is a cross-sectional view of FIG. 2 from the perspective of arrows 4-4.
Figure 4:
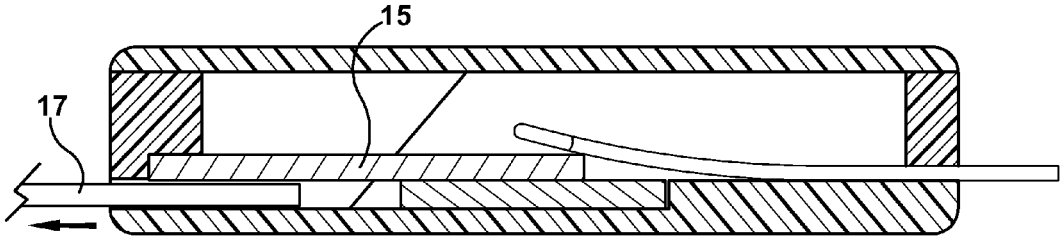
FIG. 4 is a cross-sectional view of FIG. 2 from the perspective of arrows 4-4.
Figure 5:
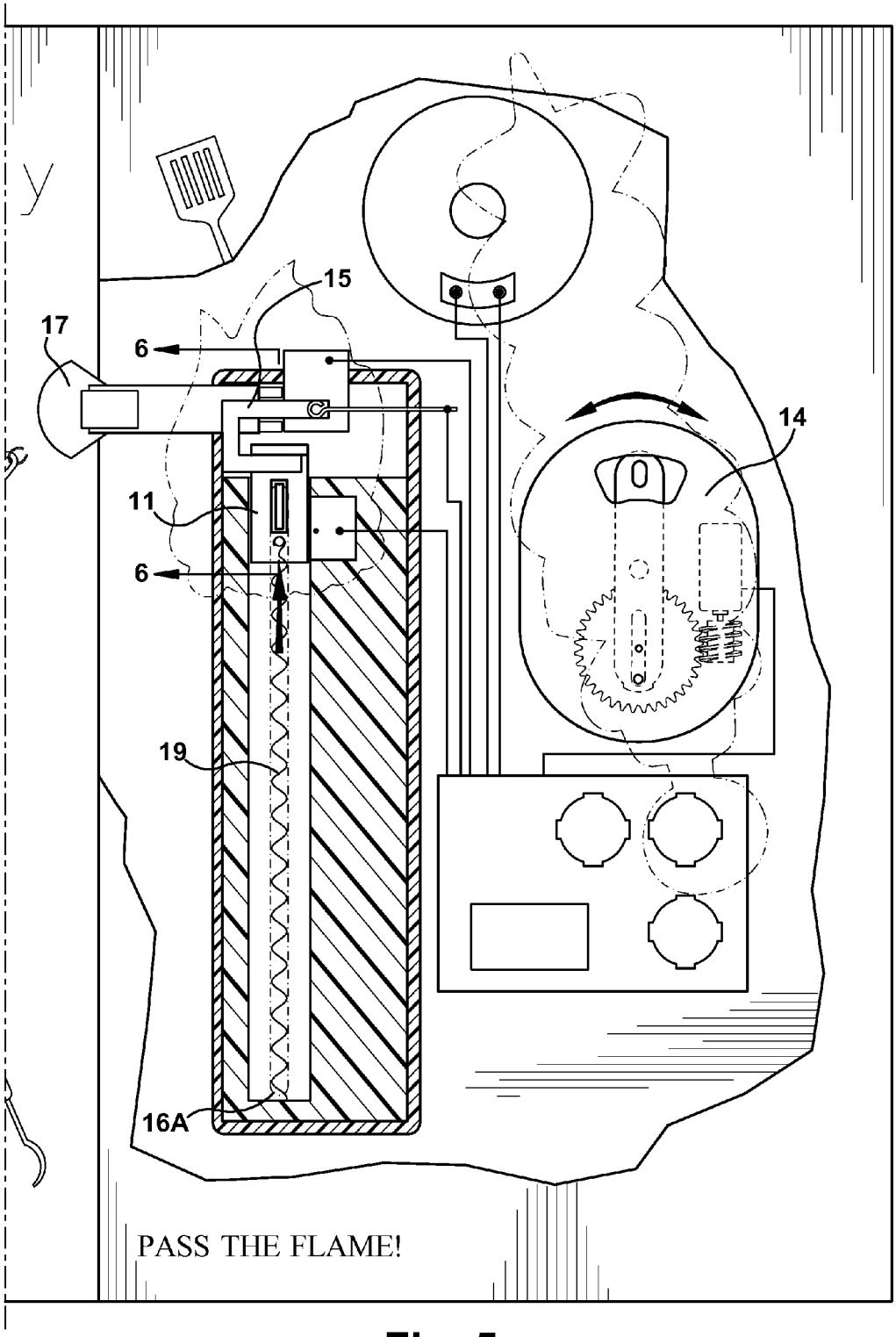
FIG. 5 is a top down view of the track/spring mechanism of the greeting card of FIG. 1 with the moveable object and retaining mechanism in a second position.
Figure 6:
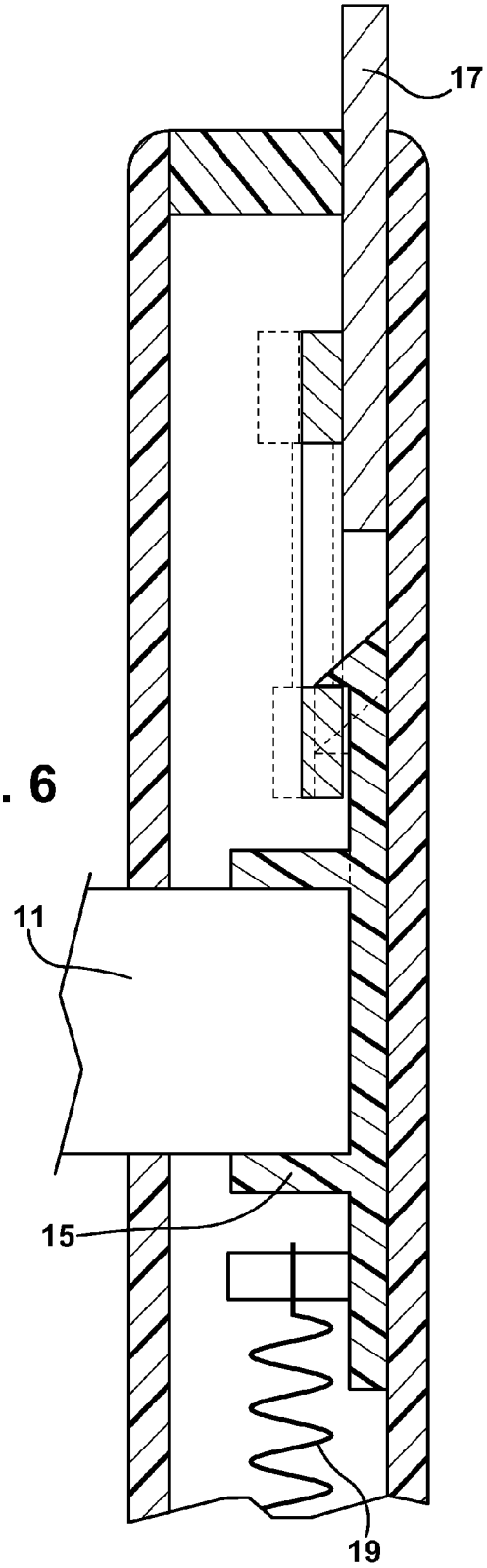
FIG. 6 is a cross-sectional view of FIG. 5 from the perspective of arrows 6-6.

In a first embodiment, shown in FIGS. 1-6, the greeting card 100 contains a first mobile object 10 which is moveable along a guided track 16 and a second mobile object 12, which is moveable by a small electric motor 14 in a back and forth, up and down, or any other reciprocating motion. The mobile objects or components 10, 12 may be shaped die cut pieces made of cardboard, paperboard, fiberboard or other such material. The first mobile object 10 is attached, through an opening or elongate slot in one or more panels of the greeting card 100, to a spring mechanism 19 via attachment means 11, contained within or connected to the molded track 16. Beginning at a first end of the track 16A (shown in FIG. 2), a user may move the first mobile component 10, 11 along the path of the track 16, stretching the spring 19 across the track 16 until the opposite or second end of the track 16B is reached. The attachment means 11 of the mobile component 10 contains a lip at one end which is operative to attach to a retaining mechanism 15, thereby holding the mobile component 10 in place at the end of the track 16B, as shown in FIGS. 5 and 6. Once the first mobile object 10 reaches the end of the track 16B (FIGS. 5 and 6), in addition to sound or light activation m a second mobile object 12 may begin to move. The mobile components 10, 12 may be shaped and decorated or designed in a way that compliments each other, the artwork or theme of the greeting card 100. For example, as shown in FIG. 1, a first moveable component 10 is a die cut piece shaped like a fire or flame and a second movable component 12 is a kobob. Once the first movable component 10 (flame) is moved along the path of the end of the track 16, which is proximate to the second moveable component 12 (kobob) begins roasting or moving once it is positioned over the first movable component 10 (fire). In this embodiment, movement of the first mobile object 10 along a track 16 initiates both audio playback and movement of a second mobile object 12, which is powered by a small electronic motor module 14. The greeting card 100 may also contain a slide trigger mechanism 17 which is located across two panels of the greeting card 100 such that when the greeting card 100 is opened, the slide trigger 17 initiates playback of an initial audio clip, shown in FIGS. 3 and 4. The initial audio clip initiated by the slide trigger 17 may direct the user to move the first mobile object 10 along the path or track 16 to hear a second message, song, or other special effect payoff, such as movement of the second mobile object 12, or the initial audio clip may simply be an additional music selection or verbal message. The slide trigger 17 may also control the release of the mobile object 10, 11 from the end of the track 16B such that after the first mobile object 10, 11 has been moved to the end of the track 16B (after audio playback and motor module are initiated) the user may close the greeting card 100, causing the retaining mechanism 15 to release the mobile object 10, 11, thereby causing the first mobile object 10 to spring back to its original position at the beginning of the track 16A. Closing the greeting card 100 may also interrupt and reset the audio playback and motor module so that the next time the greeting card 100 is opened and the first mobile object 10 is moved along the track 16, the audio playback and motor movement are re-initiated. In a preferred embodiment, at least two pre-recorded digital audio files containing instructions for the user to move the mobile object 10 along the track 16 and a second pre-recorded digital audio file being the payoff once the mobile object 10 reaches the end of the track 16. Other trigger mechanisms may be used in place of or in addition to the slide trigger 17, such as a press-button switch, light sensitive switch, touch sensitive switch, pressure switch, contact switch, or any other suitable switch or trigger mechanism or a combination thereof. The payoff for the mobile object 10 reaching the end of the track 16B may alternatively be light activation, or any other special effect(s) which can be incorporated into a greeting card. While the slide portion of the track 16 has been described as being vertically positioned, the track 16 may alternatively be horizontally positioned, may contain multiple linear segments extending in different directions or may contain curved paths through which the mobile object 10 travels.

Figure 7:
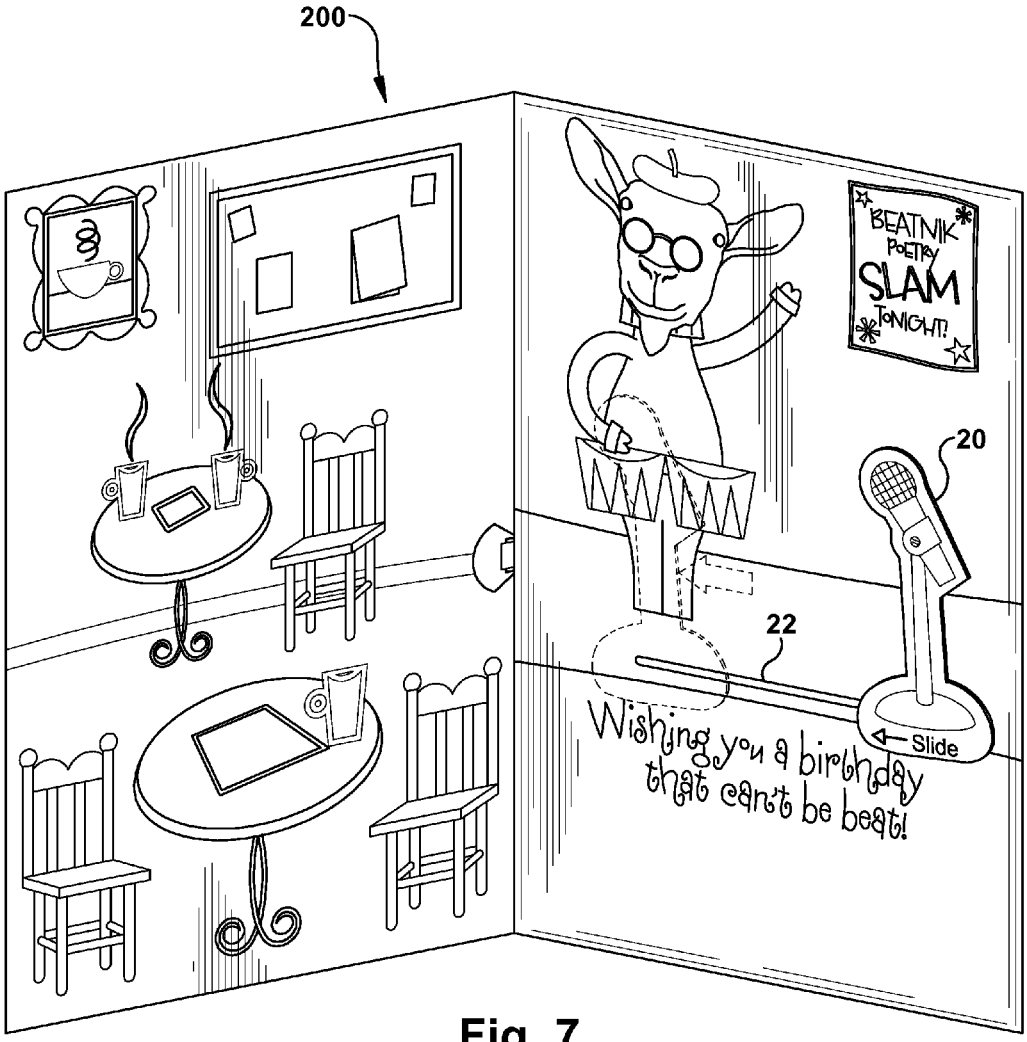
FIG. 7 is a perspective view of a second embodiment of the greeting card of the present invention.
Figure 8:
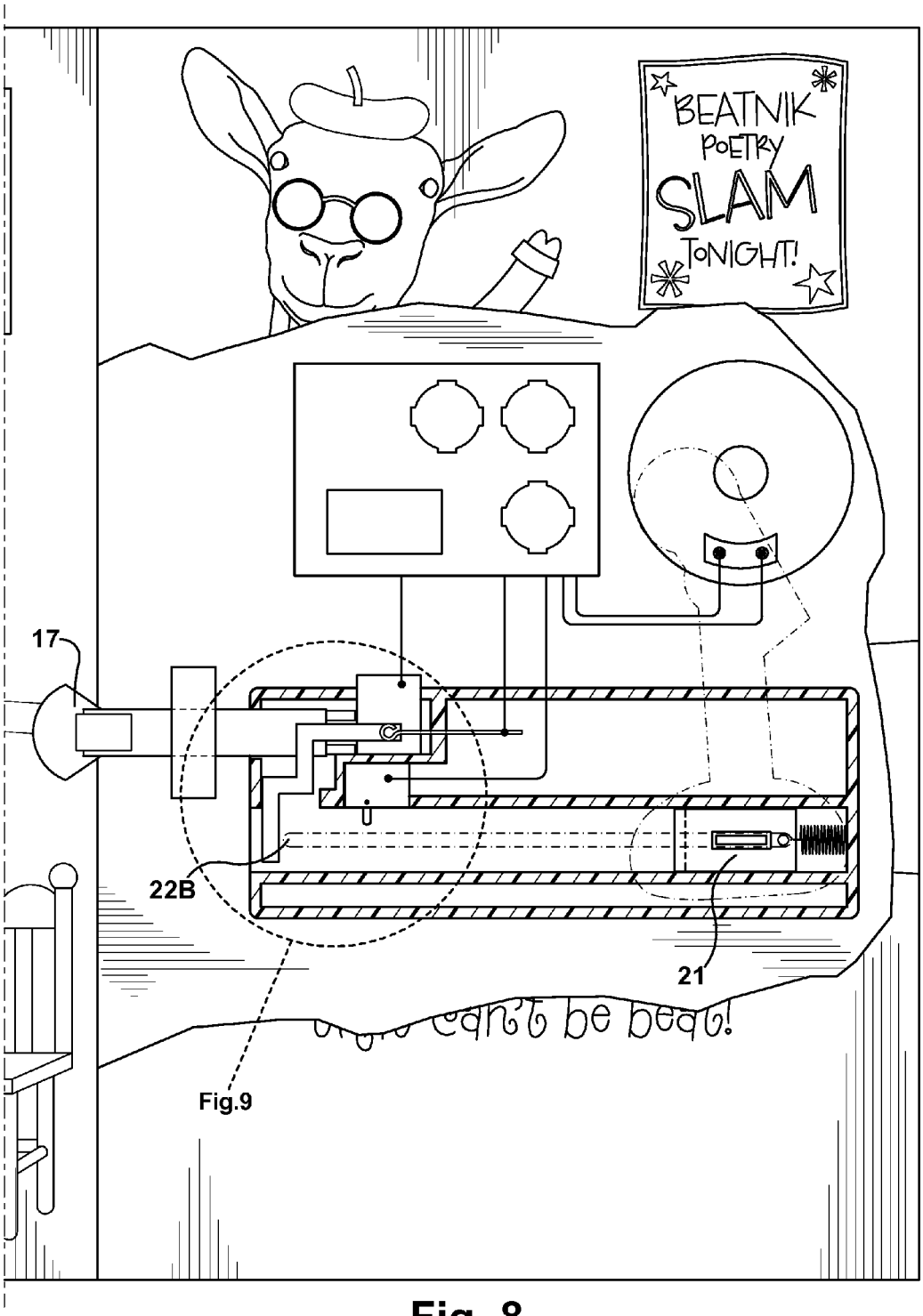
FIG. 8 is a top down view of the track/spring mechanism of the greeting card of FIG. 7, with the moveable object and retaining mechanism in a first position.
Figure 9:
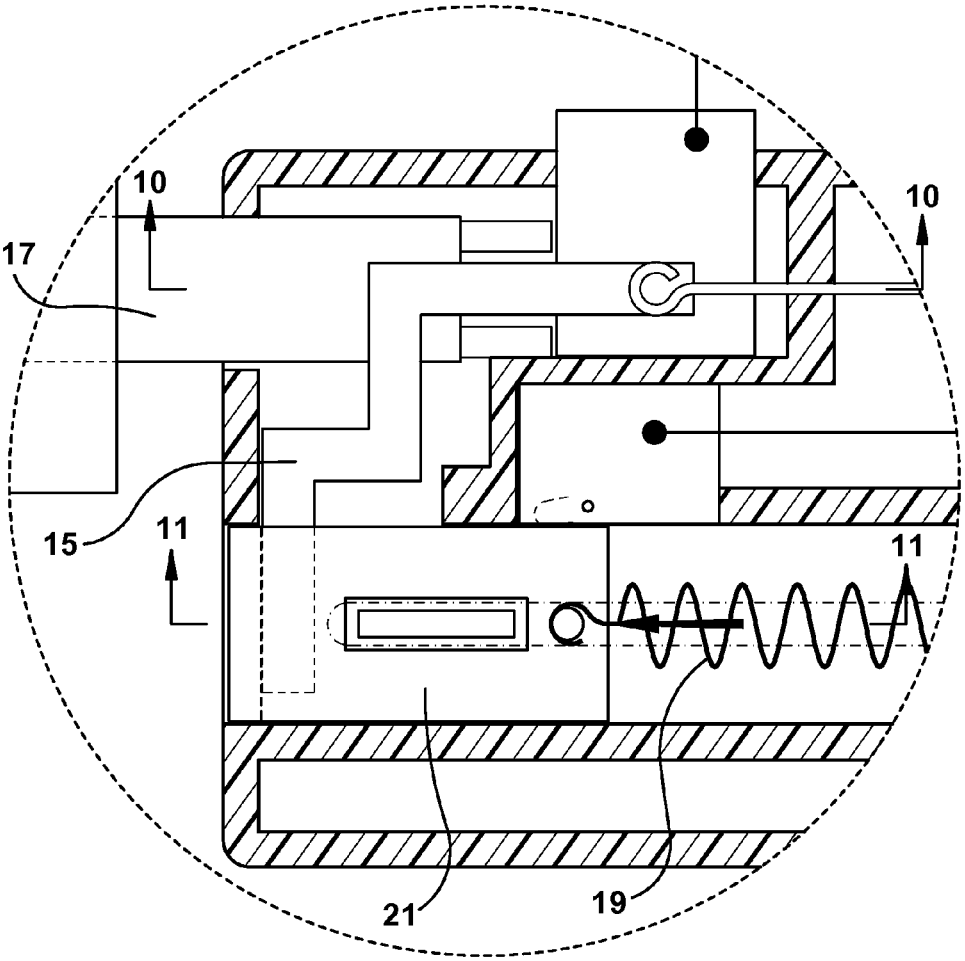
FIG. 9 is a zoomed in view of a portion of FIG. 8.
Figure 10:
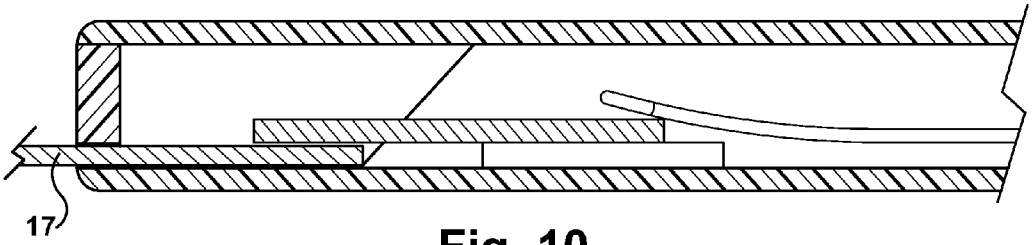
FIG. 10 is a cross-sectional view of FIG. 9 from the perspective of arrows 10-10.
Figure 11:
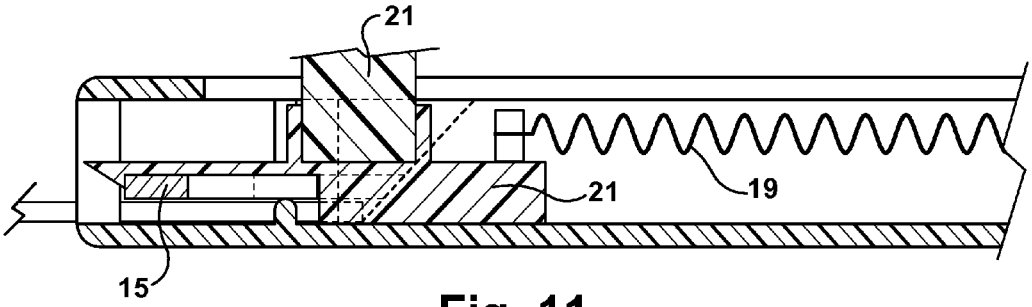
FIG. 11 is a cross-sectional view of FIG. 9 from the perspective of arrows 11-11.
Figure 12:
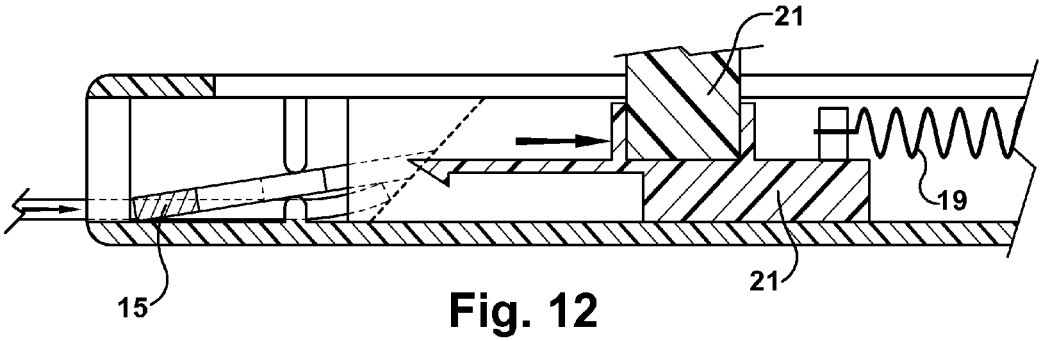
FIG. 12 is a cross-sectional view of FIG. 9 from the perspective of arrows 11-11.

In a second embodiment, shown in FIGS. 7-12, the greeting card contains a single mobile object 20 and a horizontal track 22, as shown in FIG. 7. Moving the mobile object 20 from a first end of the track 22A to a second end of the track 22B initiates playback of an audio clip. As described above with respect to the first embodiment, the mobile object 20 may be a shaped die cut piece made of cardboard, paperboard, fiberboard or other such material. The mobile object 20 is attached, through an opening or elongate slot in one or more panels of the greeting card 200, to a spring mechanism 19 via attachment means 21, contained within or connected to the molded track 22. Beginning at a first end of the track 22A (shown in FIG. 8), a user may move the mobile object 20 along the path of the track 22, stretching the spring 10 across the track 22 until the opposite or second end of the track 22B is reached. The attachment means 21 of the mobile component 10 contains a lip at one end which is operative to attach to a retaining mechanism 15, thereby holding the mobile component 20 in place at the end of the track 22B, as shown in FIGS. 11 and 12. Once the first mobile object 20 reaches the end of the track 22B (FIGS. 11 and 12), playback of an audio clip is initiated. The mobile object 20 may be shaped and decorated or designed in a way that compliments each other, the artwork or theme of the greeting card 200. For example, as shown in FIG. 7, the mobile component 20 may be shaped like a microphone which when moved along a horizontal track or path, ends up next to a picture or drawing or a person or character. Moving the mobile object 20 to the end of the horizontal track 22 or path triggers pre-recorded audio, which may be spoken words or a song performed by the character portrayed on the greeting card panel. The greeting card 200 may contain written instruction for a user to slide the microphone up to the person or character printed on the card to initiate playback of the pre-recorded audio. The greeting card 200 may also contain a slide trigger mechanism 17 which is located across two panels of the greeting card such that when the greeting card 200 is opened, the slide trigger 17 initiates playback of an initial audio clip, shown in FIG. 10. The initial audio clip initiated by the slide trigger 17 may direct the user to move the mobile object 20 along the path or track 22 to hear a second message, song or other special effect payoff or the initial audio clip may simply be an additional music selection or verbal message. The slide trigger 17 may also control the release of the mobile object 20, 21 (shown in FIG. 12) from the end of the track 22B such that after the first mobile object 20, 21 has been moved to the end of the track 22B (after audio playback) the user may close the greeting card 200, causing the retaining mechanism 15 to release the mobile object 20, 21, thereby causing the mobile object 20 to spring back to its original position at the beginning of the track 22A. Closing the greeting card 200 may also interrupt and reset the audio playback so that the next time the greeting card 200 is opened and the mobile object 20 is moved along the track 22, the audio playback is re-initiated. In a preferred embodiment, at least two pre-recorded digital audio files are contained on a memory device within the greeting card 200, one pre-recorded digital audio file containing instructions for the user to move the mobile object 20 along the track 22 and a second pre-recorded digital audio file being the payoff once the mobile object 20 reaches the end of the track 22. Other trigger mechanisms may be used in place of or in addition to the slide trigger 17, such as press-button switch, light sensitive switch, touch sensitive switch, pressure switch, contact switch, or any other suitable switch or trigger mechanism or a combination thereof. The payoff for the mobile object 20 reaching the end of the track 22B may alternatively be light activation, motor movement or any other special effect(s) which can be incorporated into a greeting card. While the slide portion of the track 22 has been described as being horizontally positioned, the track 22 may alternatively be vertically positioned may contain multiple linear segments extending in different directions or may contain curved paths through which the mobile object 20 travels.

Figure 13:
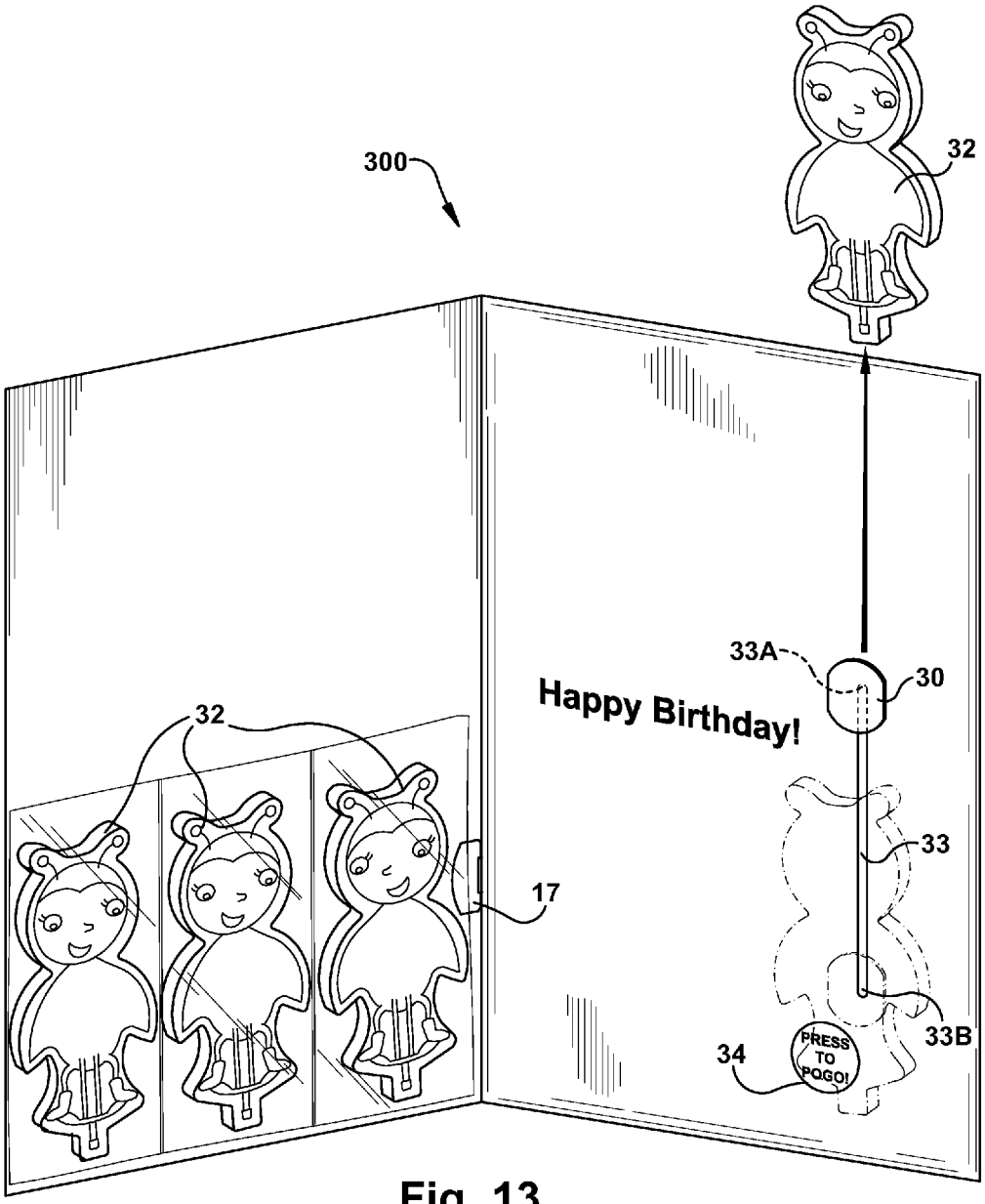
FIG. 13 is a perspective view of a third embodiment of the greeting card of the present invention.
Figure 14:
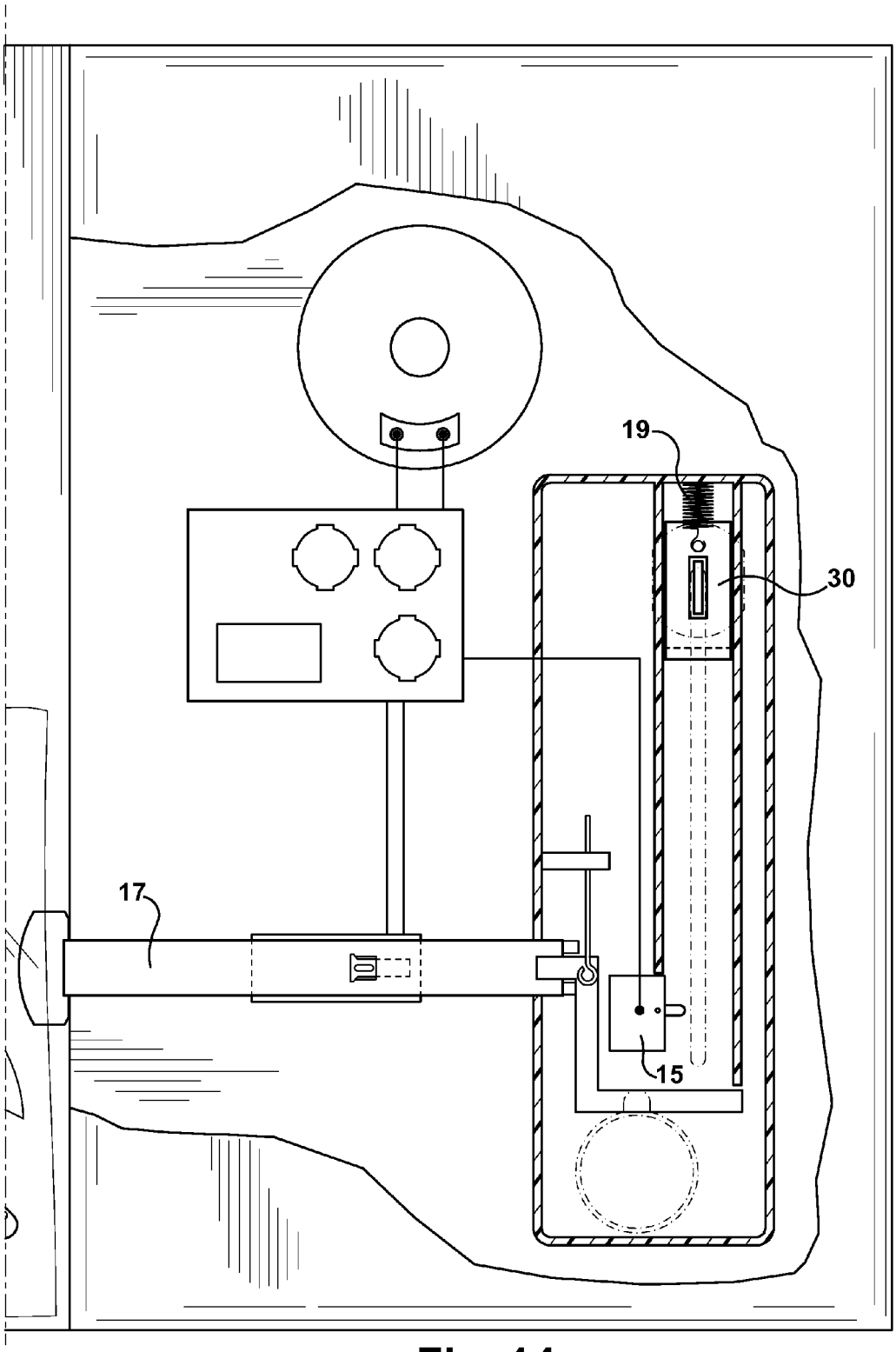
FIG. 14 is a top down view of the track/spring mechanism of the greeting card of FIG. 13.

In another embodiment of the greeting card of the present disclosure and related inventions, shown in FIGS. 13 and 14, the greeting card 300 additionally includes an object launcher. In this embodiment, the mobile object 20 is an object launcher which serves to hold a launching object 32 until said object 32 is launched or projected off the object launcher 30 and into the air. The launching object 32 can be a die cut piece shaped like a rocket or a spaceship or may be made of foam or other lightweight material. The greeting card 300 may contain electronic components, as described above with regard to the other embodiments, which initiate audio, lights, movement or other special effects. The molded track 33, as described above, can be used in this embodiment, having a track or path (preferably vertical), along which the launching object 32 may be launched. The object launcher 30 is connected through an opening or slot in one or more panels of the greeting card, to a spring mechanism 19, via attachment means 31, contained within the track 33. A slide switch 17 may be located across two greeting card panels such that when the greeting card 300 is opened a first pre-recorded audio clip is played back, which may instruct the user how to use the object launcher 30. One or more launching objects 32 may be provide with the greeting card 300. The one or more launching objects 32 may be removably attached (using glue, tack or other easily removable attachment mechanism) to one or more panels of the greeting card 300. The launching object 32 may contain an opening thereon, preferably near the bottom edge of the object, which facilitates insertion of the object 32 onto the object launcher 30. The object 32 may be slid onto or atop the object launcher 30 so that it can be easily launched into the air upon release of the object launcher 30 through the track. Other connection means may be used to attach the object 32 to the object launcher 30 so long as the object is free to "launch" or be easily removed from the object launcher 30 once the launch or release button 34 or trigger has been initiated by the user. Upon opening the greeting card, the object launcher 30 is located at a first end of the track 33A. A user must first place an object 32 onto the object launcher 30 then move or guide the object launcher 30 along the track 33 from a first end of the track 33A until it reaches a second or opposite end of the track 33B. When the object launcher 30 reaches the second end of the track 33B, a retaining mechanism 15 holds the object launcher 30 at a position at the end of the track 33B, as described above with respect to the first and second embodiments. The user can then press a push-button switch 34 located on the greeting card 300, preferably proximate to the object launcher 30, to launch the object 32 off of the object launcher 30 and into the air. The push-button 34 releases the object launcher 30 from the second end of the track 33B causing it to spring upward by force from the spring loaded object launcher 30. Alternatively, instead of a push-button switch, a touch sensitive switch, a contact switch, a light sensitive switch, a capacitance sensor, or any other type of switch or sensor may be used. Closing the greeting card 300, as described above with respect to the other embodiments, will release the object launcher 30 from the retaining mechanism 15, causing the object launcher to spring back to its original location at the first end of the track 33A. Closing the greeting card 300 may also interrupt and reset the audio playback so that the next time the greeting card 300 is opened and the object launcher 30 is moved along the track 33, the audio playback is re-initiated. In a preferred embodiment, at least two pre-recorded digital audio files are contained on a memory device within the greeting card 300, one pre-recorded digital audio file containing instructions for the user to use the object launcher 30 to launch the object 32 through the air and a second pre-recorded digital audio file being the payoff once the object launcher 30 (by pressing the push button 34), or both. Other trigger mechanisms may be used in place of or in addition to the slide trigger 17, such as a press-button switch, light sensitive switch, touch sensitive switch, pressure switch, contact switch, or any other suitable switch or trigger mechanisms or a combination thereof.

The examples described herein and shown in the figures are intended to illustrate the present invention and are not meant to limit the invention in any way. Various greeting card constructs can be used, as are known in the art and various material such as paper, paperboard, cardboard, plastic, foam, or any other material or combination of materials may be used. Also, various switches and/or sensors may be used such as light sensitive switches or sensors, touch sensitive switches or sensors, capacitance measuring switches or sensors, contact switches, push-button switches or any other switch which is known in the art. The molded track may be plastic or from other material which are capable of being molded into the appropriate shapes. The pathway or tracks along which the mobile objects travel may extend in any direction and may be linear or non-linear. The spring loaded device may be replaced by any other tension device. The track and/or mobile object or objects may be accessed through any panel of the greeting card. Any number of pre-recorded digital audio files may be contained on a memory device within the greeting card and various switches may be used to control playback of one or more of said audio files. The greeting card may additionally contain components required to facilitate the recording of personal messages, such as a microphone and recording device, which can be saved and stored in memory within the greeting card for playback upon opening the greeting card or any other user interaction.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects and expected variations and modifications of the reported results and examples are clearly within the scope of the invention where the invention is limited solely by the scope of the following claims.

The invention claimed is:

1. An interactive greeting card comprising:

a greeting card body;

a spring loaded track;

a sound module;

a motor module;

an object attached to the motor module and also attached to the spring loaded track, wherein the object can be moved between a first position at a first end of the track and a second position at a second end of the track;

wherein when the object reach the second position at the second end of the track, a circuit is closed causing one or more lights contained within the greeting card body to become illuminated and causes the sound module to replay at least one audio file contained in memory on the sound module and causes activation of the motor module which causes the object to move.

2. An interactive greeting card comprising:

a greeting card body;

a die cut shape which is connected to a track, the die cut shape able to move between a first end of the track and a second, opposite end of the track;

a light module operative to cause illumination to one or more lights contained behind a translucent material attached to the greeting card body;

a sound module operative to initiate audio playback of at least one audio file saved within the sound module;

wherein when the die cut shape reaches the second end of the track, the one or more lights become illuminated; and wherein the sound module initiates audio playback upon a user opening the greeting card.

3. The interactive greeting card of claim 2, wherein the sound module initiates audio playback upon the die cut shape reaching the second end of the track.

4. The interactive greeting card of claim 3, wherein a second die cut shape is attached to the greeting card body proximate to the second end of the track.

5. The interactive greeting card of claim 2, wherein a second die cut shape is attached to the greeting card body proximate to the second end of the track.

* * * * *